US007637735B2

(12) United States Patent
Wintrich

(10) Patent No.: US 7,637,735 B2
(45) Date of Patent: Dec. 29, 2009

(54) PROCEDURE FOR REGULATING A COMBUSTION PROCESS

(75) Inventor: Franz Wintrich, Essen (DE)

(73) Assignee: Powitec Intelligent Technologies GmbH, Essen (DE)

( * ) Notice: Subject to any disclaimer, the term of this patent is extended or adjusted under 35 U.S.C. 154(b) by 19 days.

(21) Appl. No.: 11/788,165

(22) Filed: Apr. 19, 2007

(65) Prior Publication Data

US 2007/0250216 A1 Oct. 25, 2007

(30) Foreign Application Priority Data

Apr. 25, 2006 (EP) ..... 06008487

(51) Int. Cl.
*F23N 1/00* (2006.01)

(52) U.S. Cl. ..... 431/79; 706/16; 706/40; 706/41; 706/45; 700/274; 700/29; 431/9; 431/122

(58) Field of Classification Search ..... 431/9, 431/79, 122, 13; 700/274, 28, 29, 32, 37; 706/16, 40–45
See application file for complete search history.

(56) References Cited

U.S. PATENT DOCUMENTS

| | | | | |
|---|---|---|---|---|
| 5,486,996 | A * | 1/1996 | Samad et al. | 700/32 |
| 5,890,444 | A | 4/1999 | Martin et al. | |
| 6,505,475 | B1 * | 1/2003 | Zugibe et al. | 62/192 |
| 2004/0044423 | A1 | 3/2004 | Wintrich et al. | |
| 2005/0137995 | A1 | 6/2005 | Wintrich et al. | |
| 2005/0147288 | A1 | 7/2005 | Wintrich et al. | |
| 2006/0024628 | A1 | 2/2006 | Wintrich | |

FOREIGN PATENT DOCUMENTS

| | | | |
|---|---|---|---|
| DE | 101 60 411 | A1 | 6/2003 |
| EP | 0 897 086 | A2 | 2/1999 |
| EP | 1 364 164 | B1 | 11/2003 |
| EP | 1 396 770 | A1 | 3/2004 |
| EP | 1 524 470 | A1 | 4/2005 |
| EP | 1 621 813 | A1 | 2/2006 |
| WO | WO 02/070953 | A1 | 9/2002 |
| WO | WO 02/077527 | A1 | 10/2002 |
| WO | WO 2004/018940 | A1 | 3/2004 |

* cited by examiner

*Primary Examiner*—Steven B McAllister
*Assistant Examiner*—Nikhil Mashruwala
(74) *Attorney, Agent, or Firm*—Womble Carlyle Sandridge & Rice, PLLC

(57) ABSTRACT

In a procedure for regulating a combustion process in an installation while air is being supplied, material is converted by the combustion process, with at least one flame being formed, and the state variables (s(t)) describing the state of the system in the installation are determined using at least one observation device that images the flame, as well as other sensors, and are evaluated in a computer, whereupon any appropriate actions ($a^i$) that may be needed are selected in order to control adjusting devices for the supply of material and/or air, wherein during setpoint regulation to achieve setpoints ($s_0$) of the state variables and/or stability of the combustion process a changeover is occasionally made from setpoint control to disturbance control.

25 Claims, 2 Drawing Sheets

PROCEDURE FOR REGULATING A COMBUSTION PROCESS

RELATED APPLICATION

The present application claims priority to EP 06 008 487.8, which was filed Apr. 25, 2006. The entire disclosure of EP 06 008 487.8 is incorporated herein by reference.

BACKGROUND OF THE INVENTION

The present invention relates to a procedure for regulating combustion in an installation, in particular in a power-generating plant, a waste incinerator or a cement plant, in which, with air being supplied, material is converted by way of the combustion with at least one flame body being formed, wherein the state variables, which describe the state of the system in the installation and are determined by using at least one observation device that images the flame body and also by using other sensors, are evaluated in a computer, whereupon, if necessary, suitable actions are selected in order to control adjustment devices for at least the supply of material and/or air, and wherein setpoint control is carried out to achieve setpoints of the state variables and/or stability of the combustion.

In a known procedure of the type described immediately above, regulation is either carried out automatically to achieve certain setpoints of the state variables, by comparing the actual values with the setpoint values and if necessary by implementing actions, normally by making setting adjustments, or regulation is carried out to achieve stability of the combustion process, by implementing only a small number of actions.

BRIEF SUMMARY OF SOME ASPECTS OF THE INVENTION

An aspect of the present invention is the provision of improvements to a procedure of the type described immediately above.

In accordance with one aspect of the present invention, a method is provided for regulating combustion in an installation in which the combustion converts material and forms at least one flame body. In accordance with one embodiment of the method, it comprises determining state variables that describe the state of the system in the installation, evaluating the state variables in a computer, and at least occasionally changing over from operating in a setpoint control mode to operating in a disturbance control mode. The determining of the state variables may include using at least one observation device that images the flame body, and using other sensors. Each of the operating in the setpoint control mode and the operating in the disturbance control mode may include selecting actions for controlling one or more adjustment devices for adjusting at least one of supplying air to the combustion and supplying the material to the combustion (i.e., suitable actions are selected in order to control adjustment device(s) for at least the supply of material and/or air). The selecting of the actions for controlling the adjustment devices is responsive to the evaluating of the state variables in the computer. The operating in the setpoint control mode comprises carrying out the selecting of the actions, which are for controlling the adjustment devices, in a manner that is for achieving one or more optimal setpoints for the state variables, stability of the combustion, or any combination thereof (i.e., the setpoint control mode is carried out for achieving one or more optimal setpoints of the state variables and/or stability of the combustion process). The operating in the disturbance control mode comprises carrying out the selecting of the actions, which are for controlling the adjustment devices, in a manner that is for approaching one or more states in the system in the installation at which one or more of the state variables deviate in a targeted manner within predetermined limits from the optimal setpoint(s).

In one example, the changeover from the setpoint control mode to the disturbance control mode is made occasionally. In one example of the disturbance control mode, actions are selected in order to approach system states in the installation at which the state variables deviate in a targeted manner within predetermined limits from the optimal setpoint, and as a result additional information is obtained that permits improved control. In particular, it is possible in this way to prevent the state of the system from remaining at a local minimum. Such actions would not be carried out either when regulating to achieve setpoints, where the aim is to reach a specific setpoint, nor—because they are aimed at achieving greater changes in state—would they be carried out when regulating for stability of the combustion process. Combinations of both types of control are possible in the form of compromises.

The information can be obtained regularly and as comprehensively as possible in the course of ordinary disturbance control. In addition (or, if necessary, alternatively) certain areas of states can be more intensively tested using extraordinary disturbance control.

The invention can be used in various stationary, thermodynamic installations, in particular in power-generating plants, waste incinerators and cement plants.

Other aspects and advantages of the present invention will become apparent from the following.

BRIEF DESCRIPTION OF THE DRAWINGS

The invention is explained in greater detail below by way of an exemplary embodiment illustrated in the drawings, in which.

DETAILED DESCRIPTION OF EXEMPLARY EMBODIMENT

Figure 1:
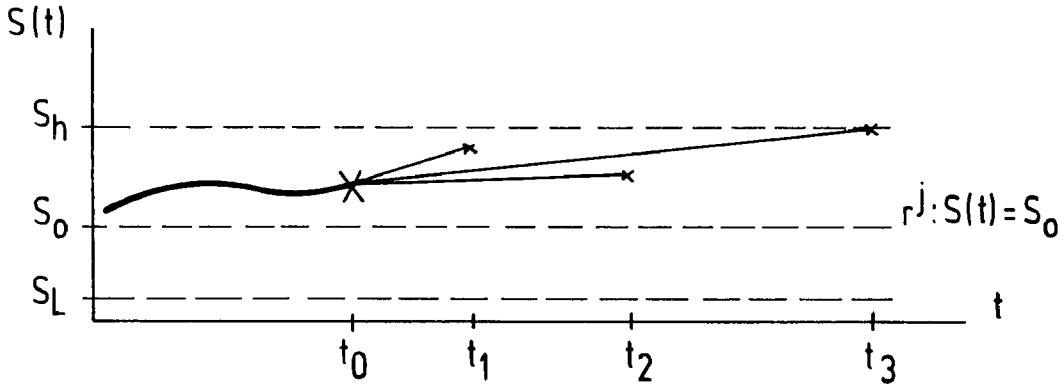
FIG. 1 is a schematic representation of the time curve of a state variable s(t) up to a time to and the predictions for the further course of the curve.

Referring now in greater detail to the drawings, an installation 1, for example a coal, oil or gas-fired power-generating plant, a waste incinerator or a cement plant, comprises a furnace 3, which more generally should also be understood to mean a grate, at least one observation device 5, which can image the interior of the furnace 3 (or the grate), preferably other sensors 7, at least one adjusting device 9, and a computer 11. The observation device(s) 5, further sensors 7 and adjusting device(s) 9 are connected to the computer 11.

Fuel, or another material to be converted, is supplied to the furnace 3 along with primary air (or primary oxygen) and secondary air (or secondary oxygen). For the sake of brevity, the fuel, or another material to be converted, (e.g. coal, oil, gas, waste material, lime, or similar material) may be generally referred to as material G. Likewise for the sake of brevity, the primary air (or primary oxygen) and secondary air (or secondary oxygen) may be generally referred to as air L. The supply of the material G and air L is regulated by the adjusting devices 9 which are controlled by the computer 11. A combustion process takes place in the furnace 3. The flame body F that is produced as a result (also any possible emissions from the walls of the furnace 3) is constantly recorded by the observation devices 5. Each of the observation devices 5 comprises an optical access passing through the wall of the furnace 3, a camera or similar device that operates in the optical range or in adjacent ranges of electromagnetic radiation, and it may also in include, for example, a lance or device as disclosed in EP 1 621 813 A1 and/or US 2006/0024628 A1. The entire disclosure of each of EP 1 621 813 A1 and US 2006/0024628 A1 is incorporated herein by reference. Preference is given to a camera having high temporal, local and spectral resolution, such as the camera described, for example, in WO 02/070953 A1 and/or EP 1 364 164 B1. The entire disclosure of each of WO 02/070953 A1 and EP 1 364 164 B1 is incorporated herein by reference.

The images of the flame body F (and of any possible emissions from the walls of the furnace 3) are evaluated in the computer 11, for example using an eigenvalue procedure as described in WO 2004/018940 A1 and/or US 2005/0147288 A1. The entire disclosure of each of WO 2004/018940 A1 and US 2005/0147288 A1 is incorporated herein by reference. EP 1 524 470 A1 describes a process by way of which a few characteristic values can be obtained from a spectrum. The entire disclosure of EP 1 524 470 A1 is incorporated herein by reference. The data obtained from the images of the flame body F, as well as the data from the other sensors 7, which measure, for example, the supply of material G and of air L, concentrations of pollutants in the waste gases, or the concentration of free lime (FCAO), are treated as state variables s(t) that describe (in a time-dependent manner) the state of the system in the installation 1 in general, and the state of the combustion process in particular, and are to be considered as a vector.

A control loop (e.g., system) is defined by the furnace 3 as a (controlled) system, the observation device(s) 5 and the other sensors 7, the computer 11 and the adjusting devices 9. It is also possible to provide a conventional control loop, with just a furnace 3, sensors 7, computer 11 and adjusting devices 9 and without the observation device(s) 5, in which the control function takes account of only a few state variables $s_t$ (i.e. it is low-dimensional) and is then optimized by including the observation device(s) 5. For example, the system in installation 1 can be regulated to achieve certain setpoints or to achieve a stable process (i.e. smooth, quasi-stationary operation of the installation 1). In both cases, the state described by the actual values of the state variables s(t) is evaluated and, if necessary, suitable adjustment actions (setting actions) are selected which are to be carried out by the adjusting devices 9. For the sake of brevity, the suitable adjustment actions (setting actions), which are selected and are to be carried out by the adjusting devices 9, are referred to as actions $a^i$. In addition to supplying the material G and air L, other activities performed by the adjusting devices 9, and possibly also the taking of a sample, may constitute an action $a^i$ within the meaning of the exemplary embodiment of the present invention. Disturbances may also be treated as unintended actions $a^i$. Adjustable combinations of the two above-mentioned control situations are conceivable, which then represent compromises.

The evaluation of the state and the selection of suitable actions $a^i$ may, for example, be accomplished by way of a procedure such as that described in WO 02/077527 A1 and/or U.S. Pat. No. 7,035,717. The entire disclosure of each of WO 02/077527 A1 and U.S. Pat. No. 7,035,717 is incorporated herein by reference. At least one neuronal network is implemented in the computer 11, with this network storing as a process model the reactions of the system states to actions $a^i$, i.e. the (non-linear) links between the values of the state variables s(t) at a time t=to and the actions $a^i$ which are then taken, on the one hand, and the resulting values of the state variables s(t) at a later (i.e. later by a certain time interval) point in time $t=t_1$ (or $t_1, t_2, t_3 \ldots$), on the other hand, i.e. at as many times t as possible in the past. In this sense, disturbances may also be included in the process model as (unintended) actions $a^i$. An evaluation of the situation, designed as a type of simplified quality, that is independent of the process model, i.e. of the stored links, evaluates the values of the state variables s(t) at a certain point in time t with respect to predetermined optimization targets $r^i$, i.e. to determine how close the system state is to the optimal state at time t. By evaluating a state predicted—by way of the process model as a function of a specific action $a^i$—at a future point in time, it is possible to determine the suitability of the specific action $a^i$ for approaching the optimization target $r^i$.

Figure 2:
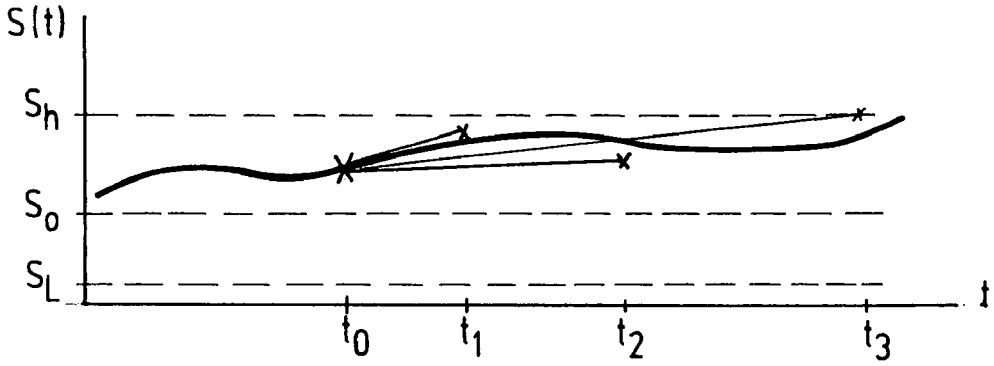
FIG. 2 is a schematic representation of the actual time curve of a state variable s(t) compared to the predictions made at time $t_0$.

Preferably three (or four) process models are stored (each in their own neuronal network) in the computer 11, with each of the process models containing links learned for one short ($t_1$-$t_0$) time interval, for one (or two) medium ($t_2$-$t_0$) time intervals, and for one long ($t_3$-$t_0$) time interval. Correspondingly, it is thus possible to make short-term, medium-term and long-term predictions. Depending on the installation 1, the time intervals (e.g., $t_1$-$t_0$, $t_2$-$t_0$, and $t_3$-$t_0$) range from a few seconds to several hours. The state variables s(t) should and can usually vary within certain limits, i.e. within an interval, for example between a lower limit value $s_1$ and an upper limit value $S_h$, around an optimal setpoint $s_0$. The values $S_1$, $S_h$ and $s_0$ can be time-dependent. The short-term, medium-term and long-term predictions serve to estimate the difference between s(t) and the optimal setpoint $s_0$ (the optimization target $r^i$ in the present case would be, for example, for $s(t)-s_0$ to be equal to 0 or at least to become minimal) and also to determine whether these limits (limit values $s_1$, $s_h$) have been adhered to, as well as to recognize the probable need for actions $a^i$. The temporal development of a state variable s(t) up to time t=to as well as the short-term prediction for $t=t_1$, the medium-term prediction for $t=t_2$ and the long-term prediction for $t=t_3$ are depicted in simplified form in FIG. 1. The actual development of s(t) compared to the predictions is then represented in FIG. 2; for better comparability no action $a^i$ has been taken.

In order to improve the accuracy, not only are the process models constantly updated by the actual developments of the state variables s(t) as a reaction to actions $a^i$, but also a competition takes place between several process models regarding the quality of the predictions. For this purpose, alternative process models, for example with other topologies, are set up and trained in the background and their predictions compared with the currently used process models in order, if necessary, to replace the currently used process models, in the manner as described, for example, in EP 1 396 770 A1 and/or US 2005/0137995 A1. The entire disclosure of each of EP 1 396 770 A1 and US 2005/0137995 A1 is incorporated herein by reference.

According to the exemplary embodiment of the present invention, it is possible to switch from normal control mode (i.e., so-called setpoint control mode) to disturbance control mode (and back again). In disturbance control mode, the computer 11 sends out test signals so that—without regard for the optimization targets $r^i$—various actions $a^i$ are taken in order, in a targeted manner, to approach in various directions initially adjacent states (i.e. adjacent to the respectively current state with regard to the state variables s(t)) and preferably—by successively sequencing the approach—also to reach more distant states. However, in order not to impede, let alone disrupt, the operation of the installation 1, only states within the limits (limit values $s_1$, $S_h$) of the state variables s(t) are selected as the target, i.e. only actions are selected in response to which the state variables s(t) will probably remain within their limits.

The computer 11 starts "ordinary" disturbance control mode at regular intervals (e.g., approximately every seven days, but at the latest every four weeks). During the ordinary disturbance control mode, as many states as possible are approached, with these states preferably being distributed as uniformly as possible within the limits (e.g., the states are substantially uniformly distributed within the predetermined limits). If the same problems occur frequently (e.g., there is a frequent reoccurrence of one or more problems) during the control procedure (e.g., during the setpoint control mode), the computer 11 starts "extraordinary" disturbance control mode. Such problems exist, for example, when the state variables s(t) frequently tend towards a limit (limit values $s_1$, $s_h$), i.e. the mean value drifts and/or frequently actions $a^i$ are needed to compensate for deviations, and/or other inconsistencies occur in the regulation to achieve setpoints (optimization targets $r^i$) and a stable process. In the case of extraordinary disturbance control, it is possible in particular to approach states which are matched to the triggering problems; for example, depending on the solution strategy, the states are selected either oriented towards the problems or in the exactly opposite direction.

Figure 3:
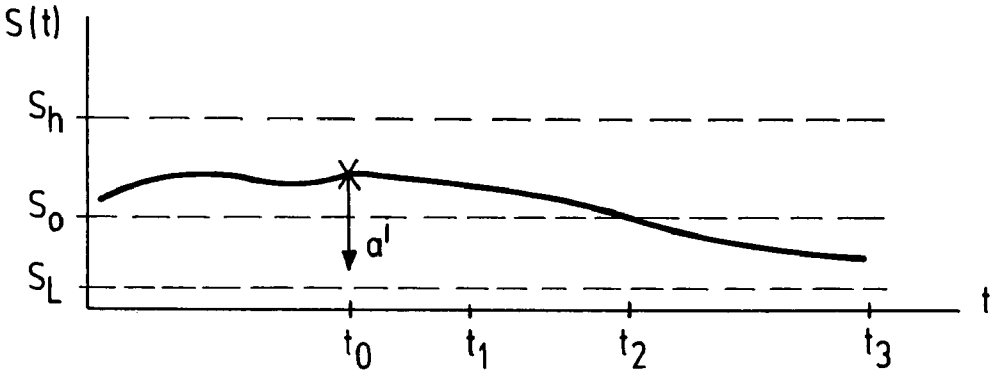
FIG. 3 is a schematic representation of the time curve of a state variable s(t) with an action $a^i$ at time $t_0$.
Figure 4:
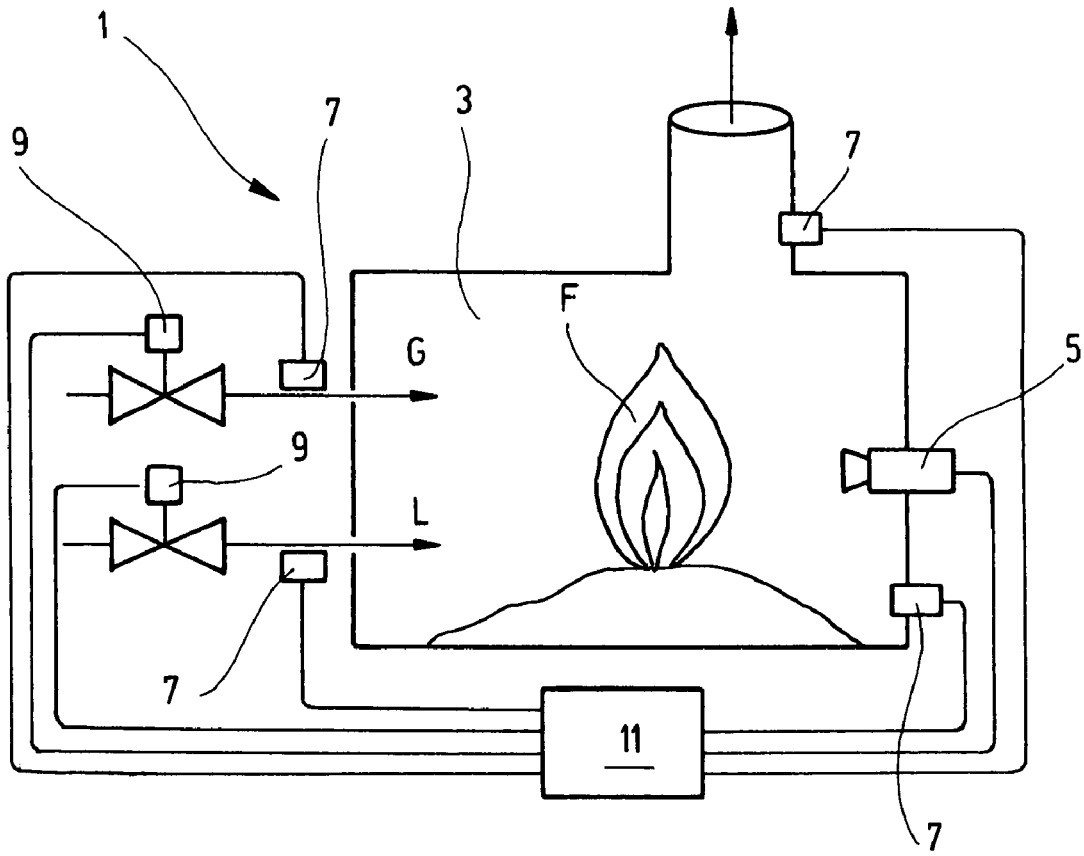
FIG. 4 is a schematic view of an installation.

In the drawings, for example, a case is depicted where s(t) fluctuates constantly above the optimal setpoint $s_0$ (FIG. 2) and tends towards the upper limit value $s_h$ also in the predictions (FIG. 1), especially the long-term prediction of the time interval $t_3$-$t_0$. In the case of setpoint control, at $t=t_0$ or $t=t_1$, an action $a^i$ would be selected that brings s(t) closer to the optimal setpoint $s_0$. In the case of disturbance control, on the other hand, for example, another action $a^i$ is also selected that brings s(t) to the lower limit value $s_1$. This is represented by an action $a^i$ at time t=to in FIG. 3.

In accordance with the exemplary embodiment of the present invention and as should be apparent to one of ordinary skill in view of the foregoing, the computer 11 (which includes appropriate input and output devices) may control the operation of the installation 1 by virtue of receiving data from and/or providing data (e.g., instructions) to respective components. For this purpose and in accordance with the exemplary embodiment of the present invention, the computer 11 includes or is otherwise associated with one or more computer-readable mediums (e.g., volatile memory and/or nonvolatile memory and/or one or more other storage devices such as, but not limited to, tapes and hard disks such as floppy disks and compact disks) having computer-executable instructions (e.g., one or more software modules or the like), with the computer handling (e.g., processing) the data in the manner indicated by the computer-executable instructions. Accordingly, the computer 11 can be characterized as being schematically illustrative of the computer-readable mediums, computer-executable instructions and other features of methods and systems of the exemplary embodiment of the present invention.

It will be understood by those skilled in the art that while the present invention has been discussed above with reference to an exemplary embodiment, various additions, modifications and changes can be made thereto without departing from the spirit and scope of the invention as set forth in the following claims.

That which is claimed:

1. A method for regulating combustion in an installation in which the combustion converts material and forms at least one flame body, the method comprising:

determining state variables that describe a state of a system in the installation, wherein the determining of the state variables comprises using at least one observation device that images the flame body, and using other sensors;

evaluating the state variables in a computer;

operating in a setpoint control mode; and at least occasionally changing over from the operating in the setpoint control mode to operating in a disturbance control mode, whereby the method comprises operating in the disturbance control mode, wherein the changing over comprises operating in the disturbance control mode while not operating in the setpoint control mode, each of the operating in the setpoint control mode and the operating in the disturbance control mode comprises selecting actions for controlling one or more adjustment devices for adjusting at least one of supplying air to the combustion and supplying the material to the combustion, wherein the selecting of the actions, which are for controlling the one or more adjustment devices, is responsive to the evaluating of the state variables, the operating in the setpoint control mode comprises carrying out the selecting of the actions, which are for controlling the one or more adjustment devices, in a manner that is for achieving at least one optimal setpoint value for at least one of the state variables, stability of the combustion, or any combination thereof, and the operating in the disturbance control mode comprises carrying out the selecting of the actions, which are for controlling the one or more adjustment devices, in a manner that is for achieving a value of the at least one of the state variables that deviates from the optimal setpoint value for the at least one of the state variables by approaching at least one state in the system at which the value of the at least one of the state variables deviates in a targeted manner within predetermined limits from the optimal setpoint value for the at least one of the state variables.

2. The method according to claim 1, wherein states that are adjacent with respect to the state variables are approached in the disturbance control mode.

3. The method according to claim 1, comprising:

regularly making a changeover from operating in the setpoint control mode to operating in the disturbance control mode; and regularly making a changeover from operating in the disturbance control mode to operating in the setpoint control mode.

4. The method according to claim 3, wherein states that are substantially uniformly distributed within the predetermined limits are approached during the disturbance control mode.

5. The method according to claim 1, wherein the changing over from the operating in the setpoint control mode to the operating in the disturbance control mode occurs in response to frequent reoccurrence of one or more problems.

6. The method according to claim 5, wherein states are approached that are matched to the one or more problems in the disturbance control mode.

7. The method according to according to claim 1, wherein several process models are used for the evaluating of the state variables and the selecting of the actions for controlling the one or more adjustment devices, in order to obtain short-term, medium-term and long-term predictions for the state variables.

8. The method according to claim 1, wherein the installation is a plant selected from the group consisting of a power-generating plant, a waste incinerating plant and a cement plant.

9. The method according to claim 5, wherein the one or more problems are selected from the group consisting of:

a frequent tendency of the state variables to tend towards a limit, a frequent need for actions to compensate for tendential deviations, inconsistencies in achieving setpoints of the state variables, and inconsistencies in achieving stable combustion.

10. The method according to claim 1, wherein:

the disturbance control mode is an ordinary disturbance control mode;

the method further comprises operating in an extraordinary disturbance control mode in response to frequent reoccurrence of one or more problems; and the operating in the extraordinary disturbance control mode comprises selecting actions for controlling the one or more adjustment devices for adjusting at least one of supplying air to the combustion and supplying the material to the combustion, so that states are approached that are matched to the one or more problems.

11. The method according to claim 1, comprising selecting, as a target, the at least one state prior to the step of carrying out of the selecting of the actions in the disturbance control mode.

12. A method for regulating combustion in an installation in which the combustion converts material and forms at least one flame body, the method comprising:

determining state variables that describe a state of a system in the installation, wherein the determining of the state variables comprises receiving data from sensors, and the receiving of the data from sensors comprises receiving data about images of the flame body;

evaluating the state variables;

generating instructions for operating in a plurality of control modes, wherein for each control mode of the plurality of control modes, the generating of the instructions comprises selecting actions for controlling one or more adjustment devices for adjusting at least one of supplying air to the combustion and supplying the material to the combustion, wherein the selecting of the actions is responsive to the evaluating of the state variables, the plurality of control modes includes a setpoint control mode and an ordinary disturbance control mode, for the setpoint control mode, the actions are selected for achieving at least one optimal setpoint value for at least one of the state variables, stability of the combustion, or any combination thereof, and for the ordinary disturbance control mode the actions are selected for achieving a value of the at least one of the state variables that deviates from the optimal setpoint value for the at least one of the state variables by approaching at least one state at which the value of the at least one of the state variables deviates in a targeted manner within predetermined limits from the optimal setpoint value for the at least one of the state variables; and at least occasionally changing over from the operating in the setpoint control mode to the operating in the ordinary disturbance control mode, including operating in the ordinary disturbance control mode while not operating in the setpoint control mode.

13. A computer-readable medium having computer-executable instructions for performing the method of claim 12.

14. The method according to claim 12, wherein the method is carried out by a computer.

15. The method according to claim 12, wherein:

the plurality of control modes further includes an extraordinary disturbance control mode;

the evaluating of the state variables comprises detecting a frequent reoccurrence of one or more problems;

the method further comprises generating instructions for operating in the extraordinary disturbance control mode in response to the detecting of the frequent reoccurrence of one or more problems; and for the extraordinary disturbance control mode, the actions are selected for approaching states that match the one or more problems.

16. The method according to claim 12, comprising selecting, as a target, the at least one state prior to the selection of the actions in the ordinary disturbance control mode.

17. A method for regulating combustion in an installation in which the combustion converts material and forms at least one flame body, the method comprising:

determining state variables that describe a state of a system in the installation, wherein the determining of the state variables comprises receiving data from sensors, and the receiving of the data from sensors comprises receiving data about images of the flame body;

evaluating the state variables;

generating instructions for operating in a plurality of control modes, wherein for each control mode of the plurality of control modes, the generating of the instructions comprises selecting actions for controlling one or more adjustment devices for adjusting at least one of supplying air to the combustion and supplying the material to the combustion, wherein the selecting of the actions is responsive to the evaluating of the state variables, the plurality of control modes includes a setpoint control mode and a disturbance control mode, for the setpoint control mode, the actions are selected for achieving at least one optimal setpoint value for at least one of the state variables, stability of the combustion, or any combination thereof, and for the disturbance control mode, the actions are selected for achieving a value of the at least one of the state variables that deviates from the optimal setpoint value for the at least one of the state variables by approaching at least one state at which the value of the at least one of the state variables deviates in a targeted manner within predetermined limits from the optimal setpoint value for the at least one of the state variables; and at least occasionally changing over from the operating in the setpoint control mode to the operating in the disturbance control mode, including operating in the disturbance control mode while not operating in the setpoint control mode.

18. The method according to claim 17, comprising selecting, as a target, the at least one state prior to the selection of the actions in the disturbance control mode.

19. A control loop comprising a computer for performing the method of claim 17, and the control loop further comprising:

the sensors, wherein the sensors are for determining the state variables that describe the state of a system in the installation, the sensors includes at least one observation device, and the observation device is for imaging the flame body; and the one or more adjustment devices.

20. The control loop according to claim 19, wherein the installation is a plant selected from the group consisting of a power-generating plant, a waste incinerating plant and a cement plant.

21. The control loop according to claim 19, wherein in the computer there is implemented at least one neuronal network which stores a process model for evaluating the state variables and selecting the actions.

22. The control loop according to claim 21, wherein the computer contains several neuronal networks with process models which compete with each other with regard to quality of predictions of the state variables.

23. The control loop according to claim 21, wherein the computer contains several neuronal networks with process models for short-term, medium-term and long-term predictions of the state variables.

24. The control loop according to claim 23, wherein the process models compete with each other with regard to quality of the predictions.

25. The control loop according to claim 19, wherein:

the disturbance control mode is an ordinary disturbance control mode;

the computer is operative so that the plurality of control modes further includes an extraordinary disturbance control mode, whereby the computer is operative for causing operating in the extraordinary disturbance control mode;

the computer is operative so that the operating in the extraordinary disturbance control mode occurs in response to frequent reoccurrence of one or more problems; and the operating in the extraordinary disturbance control mode comprises carrying out the selecting of the actions, which are for controlling the one or more adjustment devices, in a manner that is for approaching states that are matched to the one or more problems.

* * * * *